United States Patent [19]

Brooks et al.

[11] Patent Number: 4,955,165

[45] Date of Patent: Sep. 11, 1990

[54] PIPE TAPERING DEVICE

[76] Inventors: Harvey L. Brooks, 1302 NW. 14th St.; Tommy W. Cathey, HC 75, Box 2750-5, both of, Andrews, Tex. 79714

[21] Appl. No.: 347,500

[22] Filed: May 4, 1989

[51] Int. Cl.[5] ..... B24B 9/02

[52] U.S. Cl. ..... 51/331; 51/353; 51/332; 51/348; 51/351

[58] Field of Search ..... 51/241 R, 241 B, 241 S, 51/332, 331, 348, 352, 351, 73 R, 353; 82/113, 64; 408/153, 154, 173, 178, 180, 187, 203.5

[56] References Cited

U.S. PATENT DOCUMENTS

| | | | |
|---|---|---|---|
| 167,645 | 9/1875 | Cohen et al. | 82/64 |
| 2,228,964 | 1/1941 | Metz | 408/173 |
| 3,473,359 | 10/1969 | Joslin | 408/154 |
| 3,872,748 | 3/1975 | Bjalme et al. | 82/113 |
| 4,613,260 | 9/1986 | Hayes et al. | 408/178 |
| 4,624,052 | 11/1986 | Garcia et al. | 82/113 |

*Primary Examiner*—Frederick R. Schmidt
*Assistant Examiner*—Mark F. Frazier
*Attorney, Agent, or Firm*—Marcus L. Bates

[57] ABSTRACT

A pipe tapering device adapted to receive the outer peripheral marginal end of a tubing or pipe therewithin and to grind a circumferentially extending taper on a marginal end of a pipe. The apparatus is particularly suited for forming a taper on the outer surface of the marginal end of fiberglass or plastic pipe. The apparatus is adjustable and can be employed to taper the ends of a number of different size pipe diameters. The apparatus is hand held and can be powered by an ordinary drill motor.

9 Claims, 2 Drawing Sheets

PIPE TAPERING DEVICE

BACKGROUND OF THE DISCLOSURE

Fiberglass pipe is used in the oil field for handling corrosive liquids and must be joined together by a coupling member. The coupling member has a tapered female socket at each end for receiving a complementary tapered end of a length of fiberglass pipe. The lengths of pipe are received from the manufacturer with only one end tapered complementary respective to the taper of the coupled and therefore, the opposed end must be cut to the appropriate length, tapered, and then cemented or epoxied into the pipe coupling. The apparatus of the present invention provides a means by which the cut end of the pipe joint can be manually tapered complementary respective to the factory coupling.

Numerous devices for providing a taper on the end of fiberglass and plastic pipe have been disclosed by the prior art as evidenced by the references cited herein. The present disclosure relates to apparatus for tapering the outer surface of the marginal end of fiberglass or plastic tubing and pipe. The taper is in the form of a frustum of a cone and provides a circumferentially extending surface at the marginal end of the pipe made complementary respective to the taper found on a common female socket or coupling member that is to be attached to the tubing or pipe. The pipe and coupling member are usually cemented together and it is therefore desirable that the male tapered surface at the marginal end of the pipe be of a configuration that enables the entire tapered surface thereof to be received by the entire complementary female tapered surface of the fixture.

It would furthermore be desirable that such as apparatus be adjustable to thereby enable a wide range of different diameters of pipe to be suitably tapered and it would particularly be desirable that the adjustment be easily and simply carried out without the necessity of using complicated tools and the like. Apparatus which achieves the above desirable attributes is the subject of the present invention.

SUMMARY OF THE INVENTION

Apparatus for tapering the outer surface of a marginal and of a length of tubing. The apparatus comprises an outwardly opening enclosure having one end through which a tubing end is received and an opposed end affixed to a rotatable bulkhead to which a drive means can be attached. A skirt member is affixed to the bulkhead and extends therefrom and forms an opening into the enclosure for receiving the marginal end of the tubing therethrough.

A flange is rotatably mounted respective to the free depending end of the skirt member. A cam is formed into the flange and receives a cam follower thereagainst whereby relative rotational movement between the flange and the skirt drives the cam follower.

The flange and skirt are aligned along a common axis that includes the central axis of the tubing to be tapered. A plurality of grinders are radially spaced from the axis and pivotally affixed to a shaft. The shaft is set at a angle respective to the axis to form an angle equivalent to the desired angle of the taper to be formed on the end of the tubing. The cam follower is interconnected with the grinders in such a manner that relative movement between the flange and the skirt moves the grinders toward and away from the axis, thereby adjusting the diameter of the taper.

The end of a length of tubing is placed within the enclosure, a drive means is attached to the rotatable bulkhead and the apparatus is moved along the pipe axis as the taper is ground onto the outer surface of the marginal end thereof.

The flange is moved respective to the skirt whenever it is desired to move the grinders into one of a plurality of range of relative positions and thereby accommodate different diameter tubing by the apparatus.

A primary object of the present invention is the provision of apparatus for tapering the outer surface of a marginal end of a length of tubing whereby the tapered end is to be received in close tolerance relationship within a coupling member therefor.

Another object of the invention is to provide a device for tapering the ends of tubing and pipe by grinding a tapered surface thereon.

A further object of this invention is to disclose and provide a tool for preparing a tapered surface on the ends of tubing in order to receive the tapered end in close tolerance relationship within a coupling member therefor.

These and various other objects and advantages of the invention will become readily apparent to those skilled in the art upon reading the following detailed description and claims and by referring to the accompanying drawings.

The above objects are attained in accordance with the present invention by the provision of a rotatable housing having a plurality of grinders mounted therein that are brought to bear against the outer surface as described in the above abstract and summary.

DETAILED DESCRIPTION OF THE PREFERRED EMBODIMENT

Figure 1:
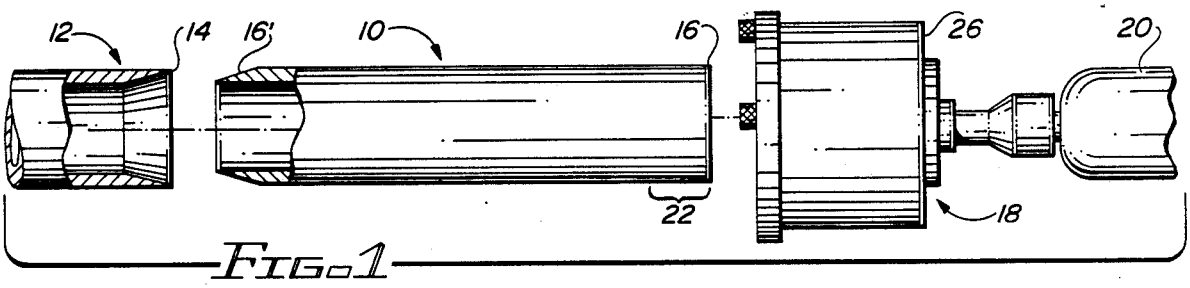
FIG. 1 is a broken, diagrammatical, side elevational repesentation of apparatus made in accordance with the present invention shown in combination with a motor, pipe, and coupling member.

In FIG. 1, there is disclosed apparatus for carrying out the present invention. A length of ordinary plastic pipe 10 is to be tapered at the ends thereof. The pipe 10 can be PVC, fiberglass, or any other composition that one may find is compatible with the present invention. A prior art coupling 12 which can take on any number of different forms, has a tapered female socket 14 at the marginal interior end thereof and it is desirable that the pipe 10 have a marginal end 16 tapered in a manner illustrated by numeral 16', whereby the taper 16 is made complementary respective to the female socket 14 and the pipe is received within the socket 14 in close tolerance relationship there-with. In this patent application, the term pipe and tubing are used interchangeably.

Apparatus 18 for tapering the outer surface 16 of a marginal end of a length of tubing 10 is advantageously rotated or powered by air motor 20, as for example the air motor associated with an air drill. Alternatively, the motor 20 can be a 12 volt reduced gear drive motor that is driven from a vehicle battery, for example.

Figure 2:
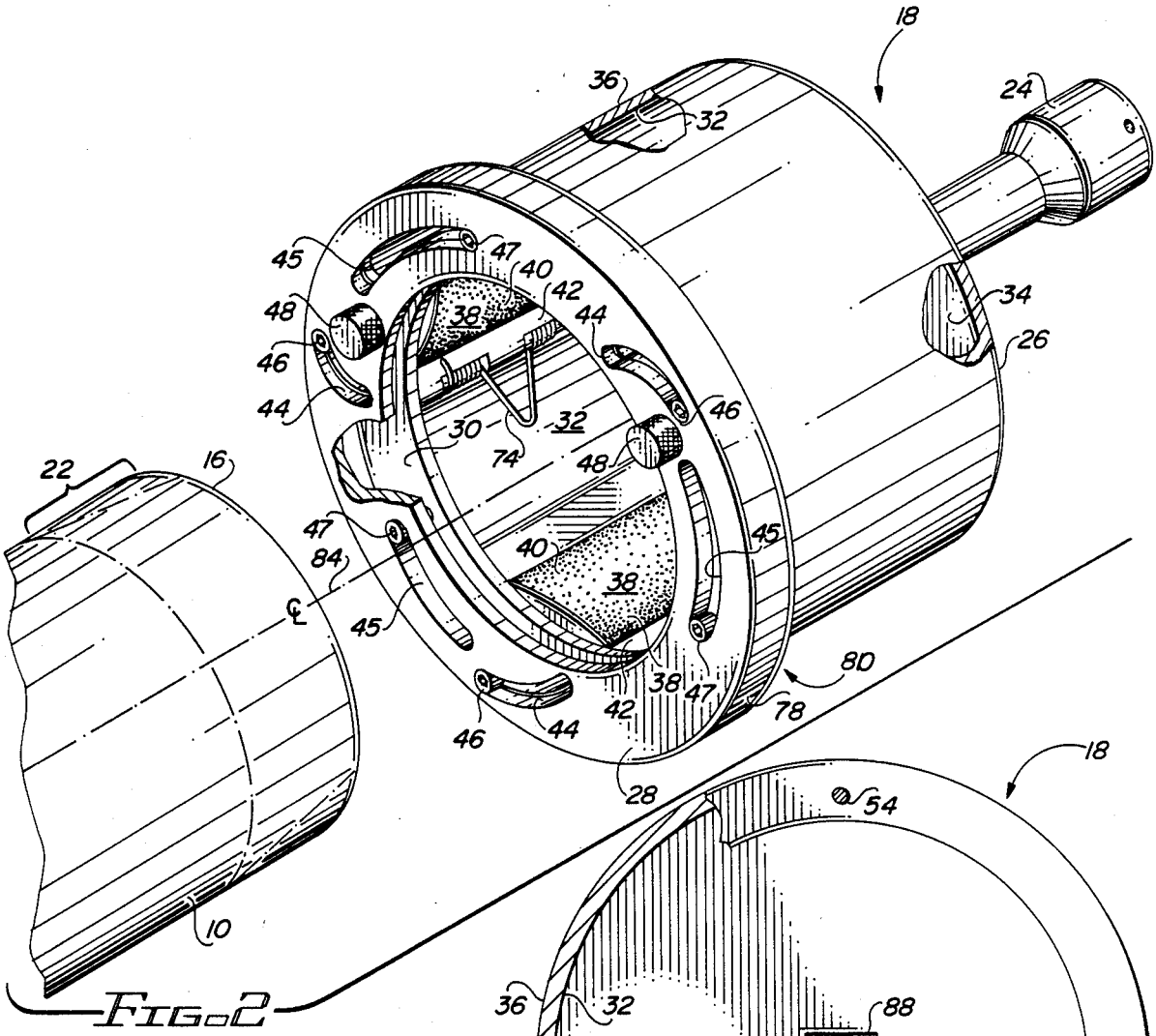
FIG. 2 is an enlarged, three-quarter, left, perspective view of the present invention, with some parts being removed therefrom so as to disclose the details of some of the hidden parts.

Numeral 22 of FIG. 2 illustrates the outer surface of a marginal end 16 of a length of tubing where the desired taper 16' is to be formed. Drive member 24 is attached to rear bulkhead 26. A rotatable outer flange 28 is parallel and opposed to the bulkhead 26. A fixed inner flange 30 is positioned parallel and spaced from the rotatable outer flange 28. The fixed inner flange 30 is inwardly directed respective to the illustrated inner cylindrical wall surface 32. Numeral 34 indicates the inner surface of the bulkhead 26. Accordingly, the inner surface 34 of the bulkhead, together with the inner cylindrical wall 32, presents an outwardly opening enclosure having one end through which a tubing end 16 is received and an opposed end affixed to a rotatable bulkhead 26 to which a drive means 20 can be attached.

In FIGS. 2–6, the apparatus has an outer cylindrical wall surface 36 supported by the bulkhead 26. A plurality of grinding members 38 are positioned within the skirt member 36 for forming a taper 16' on the marginal end 22 of pipe 10. Grinding material 40 is supported on the inner surface of the grinding member. The grinding member has a pivoted end 42.

Figure 4:
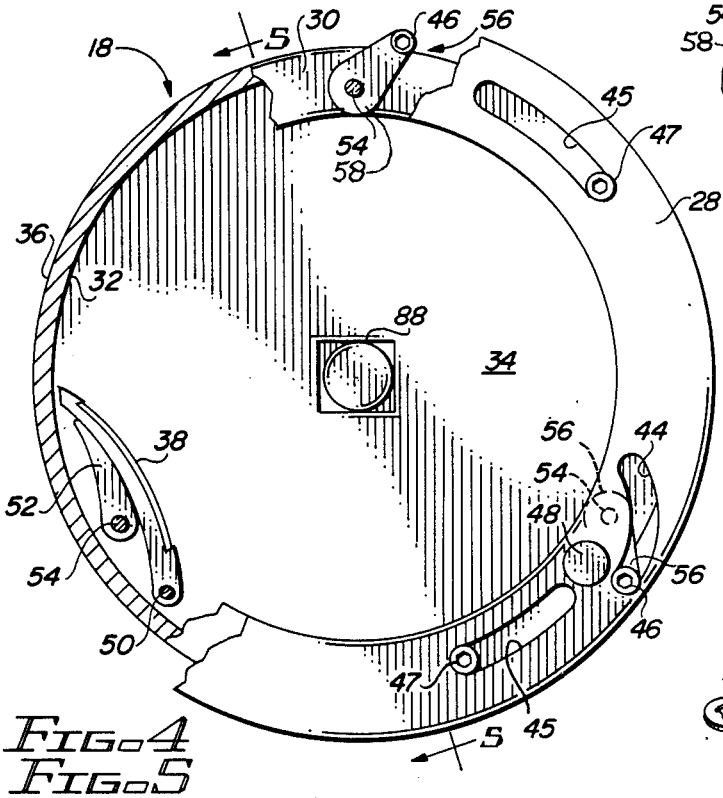

In FIGS. 2 and 4, cam 44 is formed within the outer flange 28. A plurality of guide and limit curved slots 45 extend through the flange 28. A cam follower 46 is urged against cam 44 and moves whenever the flange 28 is moved respective to the skirt. Guide pin 47 is attached to the fixed inner flange 30 and is received within the curved slot 45.

Opposed size selectors 48 extend outwardly from the movable flange 28. The selectors 48 each are spring loaded and have a reduced diameter part thereof that forms a pin and the pin extends through the outer flange 28 and into one of a plurality of detents formed within the inner or fixed flange 30.

In FIGS. 3–6, the grinding members 38 are seen to be pivotally attached the enclosure by the illustrated shaft 50. A curved actuating lever for pivotally moving the grinding member 38 is mounted on shaft 54. The shafts 50, 54 are spaced from one another in the illustrated manner of FIGS. 3–5.

Figure 5:
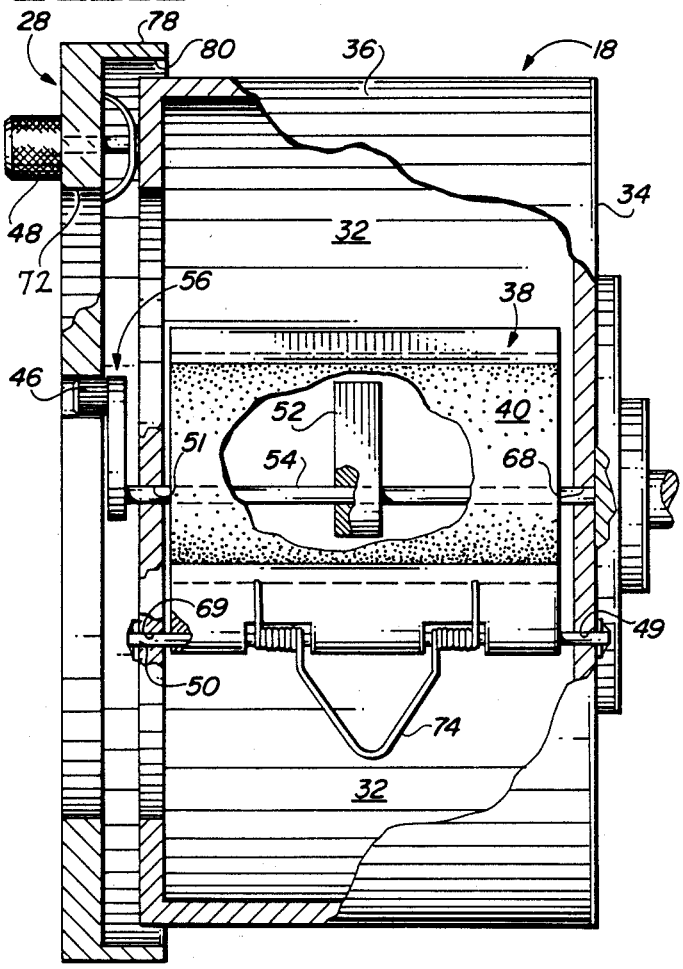
FIG. 5 is an enlarged, longitudinal, part cross-sectional view taken along line 5—5 of FIG. 4; and, FIG. 6 is an enlarged, perspective, exploded, detailed view of part of the apparatus disclosed in FIGS. 4 and 5.
Figure 6:
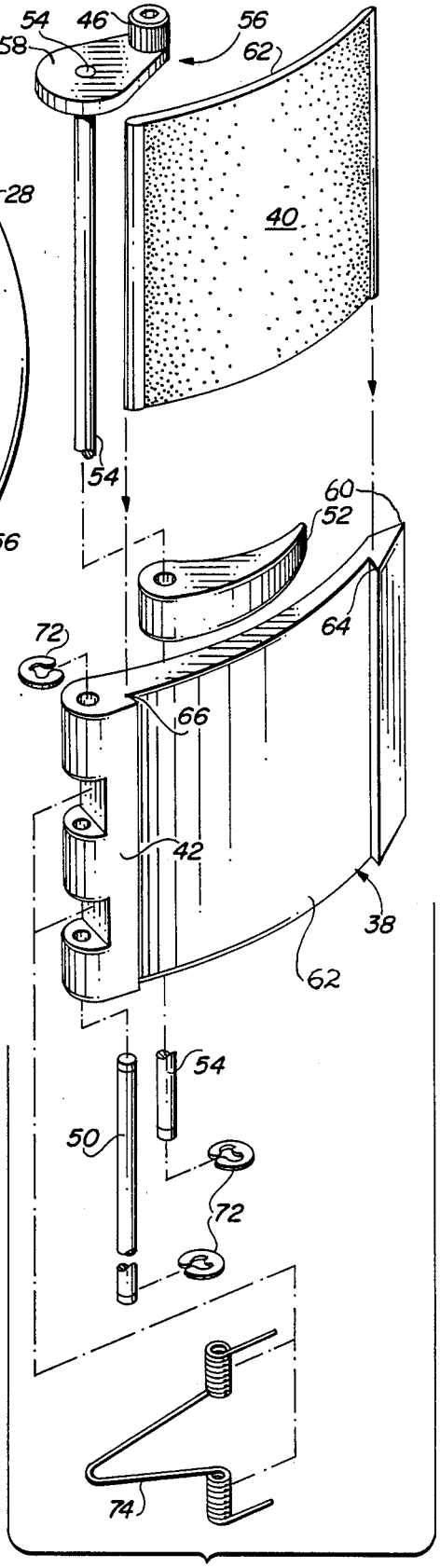

In FIGS. 5 and 6, crank assembly 56 interconnects the cam follower 46 with the shaft 54, while the cam follower 46 and shaft 54 are interconnected by means of the illustrated flat lever 58.

As best seen in FIG. 6, together with other figures of the drawings, the grinding member 38 has a trailing end 60 spaced from the nose or pivoted end 42, with there being the before mentioned grinding material 40 removably mounted therebetween. The medial part of the grinding member 38 has a recess 62 formed therein that extends from groove 64 at one end thereof to the groove 66 at the other end thereof. The grinding material 40 preferably is in the form of a flat sheet of material that can be replaced by sliding a suitable sized piece of the material into and from the recess.

Numeral 68 of FIG. 5 is a bore for shaft 54. Fastener 72 maintains the shafts 50, 54 properly aligned with respect to the enclosure. In FIGS. 2 and 5, lip 78 extends from the flange 28 and towards the bulkhead 34. The lip has an inside peripheral area 80. The flange has a central opening 72 of a diameter for accommodating the miximum size pipe desired.

OPERATION

In operation, the spring loaded size selectors 48 are placed in the appropriate position to achieve the desired taper. The selectors 48 are pulled away from the flange which allows the flange to be rotated into the required position to provide the proper spacing of the grinding members. Then the size selectors are released to allow the pin thereof to be returned into the detents 86. This holds the movable flange in fixed relationship respective to the fixed skirt flange 30, with the grinding members 38 being pivoted towards one another the amount required to place a suitable taper surface on a selected diameter plastic pipe.

Figure 3:
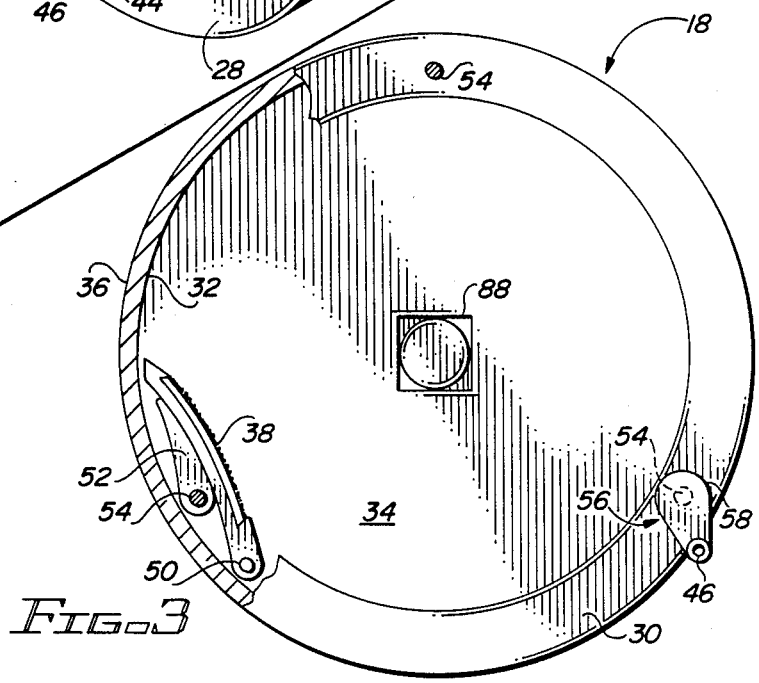
FIGS. 3 and 4 are broken, partially disassembled end views of part of the apparatus disclosed in FIGS. 1 and 2.

After release of selectors 48, as the flange 28 is rotated respective to the skirt 36, the cam follower 46 pivots the cam shaft 54, which in turn pivots the actuating lever 52. The actuating lever 52 bears against the bottom surface of the grinding member 38 in the manner of FIGS. 4 and 5, and forces the grinding member to pivot about shaft 50 as the actuating lever 52 is rotated. As best seen in FIGS. 3–5, the abrasive surface 40 on the curved abrasive face 40 of grinding member 38 is brought to bear at an angle respective to the centerline of the pipe and skirt. The angle determines the slope of the tapered surface 16' and is determined by the location of shaft holes 68, 69 and 49, 51.

The drive member 24 preferably is a half inch socket extension that is attached to a complementary female receptacle 88 formed in the bulkhead 26. A suitable power source, such as an air motor or electric drill motor 20, is connected to rotate the socket driver 24. The end of the pipe 10 is placed within the outwardly opening enclosure as the motor 20 is brought up to speed, thereby rotating the pipe tapering tool 18 of the present invention at any desired rpms depending upon the size of the pipe and the capability of the motor 20 and the operator. The rpm, for example only, can be as low as 200 for some size pipe and as much as 1800 for other size pipe. The tool 18 is forced toward the pipe by controlling the pressure exerted against the motor 20. The length of the taper 22 is acceptable when the pipe end abuts the inside surface 34 of the bulkhead 26. At that time, the tool is removed from the end of the tapered pipe and the next length of pipe can be tapered with the apparatus 18.

I claim:

1. Apparatus for tapering the outer surface of a marginal end of a length of tubing, comprising:

an outwardly opening enclosure having a free depending end through which a tubing end can be received and an opposed end that terminates in a rear bulkhead to which a drive means can be attached; said enclosure is formed by a skirt member that is fixed to said rear bulkhead and extends therefrom and forms said outwardly opening enclosure;

a flange means rotatably mounted at said free depending end of said skirt member; cam means supported adjacent said flange means, a cam follower engaging said cam means;

a plurality of circumferentially spaced grinders; means pivotally mounting each said grinder within said enclosure for pivotal movement towards and away from the central axis of said skirt member;

means connnecting said cam means and said follower whereby rotation of said flange means in one direction respective to said skirt member moves said grinders towards the central axis of said skirt member; said grinders each are a segment of a cylinder and have a curved abrasive surface that can be pivotally moved into engagement with the end of a tubing that lies along the central axis of the skirt member to thereby grind the tubing marginal end into the form of a taper.

2. The apparatus of claim 1 wherein an inner flange is attached to the free end of said skirt; said flange means is of annular construction; said cam means is part of said flange means; whereby, rotation of said flange means respective to said skirt moves the grinders toward and away from one another.

3. The apparatus of claim 2 wherein said cam means includes a linkage, and a crank that is moved by relative rotation between the flange means and inner flange and thereby pivots each of the grinders into contact with the marginal end of the tubing.

4. The apparatus of claim 1 wherein said flange means is an annular rotatable member which is rotatably positioned on the free end of said skirt, said cam means is formed on said annular rotatable member, whereby, rotation of said annular rotatable member respective to said skirt moves the grinders toward and away from one another.

said grinders have opposed ends, one of which is pivotally connected at opposed terminal ends of said skirt member and the other of which can pivotally move about the connected end, spring means urging said grinders away from the longitudinal axis of said skirt, and an actuating lever connected to said cam folower for simultaneously forcing the grinders towards the longitudinal axis of the housing.

5. Apparatus for tapering the marginal end of plastic tubing, comprising:

a rotatable housing in the form of a cylindrical skirt having a closed end that can be secured to means for rotation, and an open end through which a marginal end of a length of tubing can be received, with the cental axis of the housing coinciding with the central axis of the tubing;

an annular flange supported at the open end of said skirt, means by which said flange is rotatably positioned respective to said skirt, cam means formed on said annular flange, a plurality of grinders, means by which each said grinder is pivotally mounted within said housing; said grinders are oriented to be movable towards and away from the longitudinal central axis; whereby, rotation of said annular flange moves the cam means and thereby moves the grinders toward and away from the longitudinal axis of said skirt;

said grinders each having a curved abrasive surface that may be brought into contact with a marginal tubing end to abrade the marginal end of the tubing into a taper;

a crank, a cam follower; linkage connecting said cam means and said cam follower, said cam follower engages said cam means for moving said linkage and thereby pivoting said grinding member into engagement with a tubing surface;

whereby, relative rotation between said annular flange and said housing moves said cam follower and thereby pivots said grinders towards and away from the central axis of the housing; whereupon, the grinders can be brought into engagement with the outer peripheral surface of a marginal end of a length of tubing to thereby form a tapered surface on the marginal end thereof.

6. The apparatus of claim 5 wherein said grinders are spring loaded to pivot away from the longitudinal central axis of the skirt; said grinders are a segment of a cylinder and have a curved abrasive surface that is brought into contact with the tubing marginal end to thereby abrade the marginal end into a taper; means on the curved surface of the grinders for removably receiving a high abrasive grinding surface.

7. The apparatus of claim 5 wherein said linkage interconnects said crank and said grinders, and is moved by rotation of the annular flange respective to the sleeve and thereby pivots the grinders into contact with the end of a length of tubing that may be supported along the central axis of the housing.

8. The apparatus of claim 7 wherein said annular flange has a cylindrical part that is concentric respective to the skirt and an inwardly directed part that extends towards the longitudinal central axis of the housing and forms the terminal end of said apparatus and is rotatably positioned respective to the free end of said skirt;

said grinders are spring loaded to pivot away from the central axis; said grinders each have a curved abrasive surface that is brought into contact with the tubing marginal end to thereby abrade the end into a taper; and means on the curved surface of the grinders for removably receiving a high abrasive grinding surface.

9. The apparatus of claim 8 wherein the open end of said housing has an inwardly turned circumferentially extending end member attached thereto for supporting said annular flange, a shaft for said grinders; said shaft has opposed ends with one end supported by the bulkhead and the opposed end supported by said inwardly directed part;

and said inwardly directed part of said annular flange is superimposed over said inwardly turned end member.

* * * * *

UNITED STATES PATENT AND TRADEMARK OFFICE

CERTIFICATE OF CORRECTION

PATENT NO. : 4,955,165

DATED : September 11, 1990

INVENTOR(S) : HARVEY L. BROOKS & TOMMY W. CATHEY

It is certified that error appears in the above-identified patent and that said Letters Patent is hereby corrected as shown below:

Column 1, line 12, "coupled" should read --coupler-- ;
Line 47, "and" should read --end-- .

Column 3, line 45, insert --to-- after "attached" ;
Line 46, insert --52-- after "lever" .

Column 4, line 3, "mixium" should read --maximum-- .

Column 5, line 35, "folower" should read --follower-- ;
Line 36, "towards" should read --toward-- ;
Lines 53-56, "whereby, rotation of said annular flange moves the cam means and thereby moves the grinders toward and away from the longitudinal axis of said skirt;" should be deleted.

Column 6, lines 50-52 should read: --has opposed ends with one end supported by the closed end of the skirt and the opposed end supported by said inwardly turned end member; -- instead of as printed.

UNITED STATES PATENT AND TRADEMARK OFFICE

CERTIFICATE OF CORRECTION

PATENT NO. : 4,955,165

DATED : September 11, 1990

INVENTOR(S) : HARVEY L. BROOKS & TOMMY W. CATHEY

It is certified that error appears in the above-identified patent and that said Letters Patent is hereby corrected as shown below:

Column 6, lines 5-9 should read: --a crank connected to a cam follower; linkage connecting said grinding members to said crank; said cam follower engages said cam means for moving said crank and said crank moves said linkage and thereby pivoting said grinding members into engagement with a tubing surface;-- instead of as printed;

Column 6, line 26 should read: --7. The apparatus of claim 5 wherein said linkage includes an actuating lever that-- instead of as printed;

Signed and Sealed this

Twenty-eighth Day of January, 1992

*Attest:*

HARRY F. MANBECK, JR.

*Attesting Officer*

*Commissioner of Patents and Trademarks*